United States Patent [19]

Penney

[11] 3,966,435

[45] June 29, 1976

[54] ELECTROSTATIC DUST FILTER

[76] Inventor: Gaylord W. Penney, 216 Paris Road, Pittsburgh, Pa. 15235

[22] Filed: May 2, 1974

[21] Appl. No.: 466,131

[52] U.S. Cl. ..... 55/131; 55/138; 55/150; 55/154

[51] Int. Cl.[2] ..... B03C 3/00

[58] Field of Search ..... 55/101, 107, 128, 129, 55/130, 131, 134, 136, 138, 148, 150, 151, 154, 155, 156, 341

[56] References Cited

UNITED STATES PATENTS

| | | | |
|---|---|---|---|
| 2,067,822 | 1/1937 | Biederman | 55/131 X |
| 2,701,621 | 2/1955 | Sprague | 55/455 X |
| 2,924,293 | 2/1960 | Sprague | 55/136 X |
| 3,154,682 | 10/1964 | Hartz et al. | 55/131 X |
| 3,375,638 | 4/1968 | Dungler | 55/116 |
| 3,616,606 | 11/1971 | Vincent | 55/138 X |
| 3,733,784 | 5/1973 | Anderson et al. | 55/379 X |

FOREIGN PATENTS OR APPLICATIONS

| | | | |
|---|---|---|---|
| 581,530 | 9/1924 | France | 55/131 |
| 766,263 | 4/1934 | France | 55/131 |
| 739,036 | 9/1943 | Germany | 55/138 |
| 846,522 | 8/1960 | United Kingdom | 55/138 |

*Primary Examiner*—Frank W. Lutter
*Assistant Examiner*—David L. Lacey
*Attorney, Agent, or Firm*—Brown, Murray, Flick & Peckham

[57] ABSTRACT

An electrostatic dust filter is provided for collecting electrically-charged dust particles which are deposited on fabric filter elements in an electric field so that the particles deposit in porous layers. The dust particles are charged in a manner to provide a mixture of particles charged with opposite polarities, and adjacent filter members are maintained at opposite polarities. Unidirectional electric fields thus exist between adjacent filter elements and the dust particles deposit on one or the other filter element according to their polarity. A relatively simple structure is provided which requires no separate electrodes to maintain the electric field.

15 Claims, 8 Drawing Figures

ELECTROSTATIC DUST FILTER

BACKGROUND OF THE INVENTION

The present invention relates to electrostatic dust filters, and more particularly to fabric filters for removing dust particles or other particulate matter from a stream of air or other gas.

Conventional fabric dust filters consisting essentially of a layer of cloth, or other textile fabric, are very efficient dust collecting devices. The effectiveness of these devices, however, is not primarily due to the fabric filtering element itself but results from the layer of dust which collects on the fabric. This layer of dust provides a very effective filtering action but it tends to build up into a substantially impervious layer which results in excessive pressure drop across the filter. This is highly undesirable because of the excessive amount of power required to force a given flow of gas through the filter and necessitates frequent cleaning or replacement of the filter element.

In my copending application Ser. No. 381,781, filed July 23, 1973, now Pat. No. 3,910,779, issued Oct. 7, 1975, there is disclosed and claimed an electrostatic dust filter in which the dust deposits in a relatively porous layer so as to maintain a low pressure drop across the filter. This result is obtained by electrically charging the dust particles and maintaining an electric field at the surface of the fabric filter element so that the dust is deposited on the filter element in the electric field. The slight surface irregularities of the filter tend to concentrate the electric field and the charged dust particles follow the field so that they tend to deposit on these irregularities. This further concentrates the field and causes the dust to deposit in closely-spaced columns or pyramids so that the layer of dust remains relatively porous. A very effective filtering action with low pressure drop is obtained in this way but a relatively complicated and expensive construction is required for the filter itself to charge the dust particles in the desired manner while limiting the resulting space charge, and to maintain the required electric field at the surface of the filter elements.

SUMMARY OF THE INVENTION

In accordance with the present invention, there is provided an electrostatic dust filter in which the dust is deposited in an electric field to obtain a relatively porous dust layer, as in the prior application mentioned above, but in which the required structure is much simpler and less expensive.

The filter of the present invention preferably includes both a charging section and a filtering section. The dust-carrying gas is first directed through the charging section in which the dust particles are electrically charged in a manner which results in a mixture of approximately equal numbers of oppositely-charged particles so that the resultant space charge is essentially zero and no special provisions are necessary for limiting the space charge. The filtering section consists of a plurality of filtering means providing spaced, generally parallel filter elements through which the dust-carrying gas passes. A unidirectional electric field is maintained between each pair of adjacent filter elements such that they are of opposite polarities. This may be done by grounding alternate elements with the remaining elements maintained at a high potential or, if desired, alternate filter elements may be maintained at a high potential of one polarity with the intervening elements at a high potential of opposite polarity. The mixture of dust particles enters the spaces between adjacent filter elements and particles of one polarity move to one filter element while those of the opposite polarity move to the other filter element. The dust particles thus deposit on the filter surfaces in porous layers in the same manner as in the prior application, but the filter itself is of simpler and less expensive construction since the required field can be maintained in a much simpler manner.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1A:
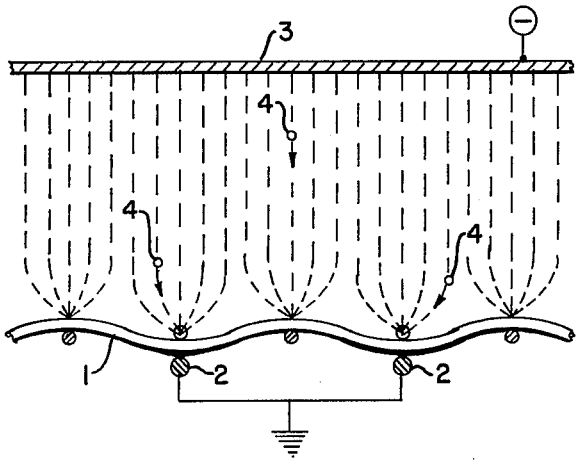
FIGS. 1A and 1B are diagrammatic views illustrating the principle of the invention.
Figure 1B:
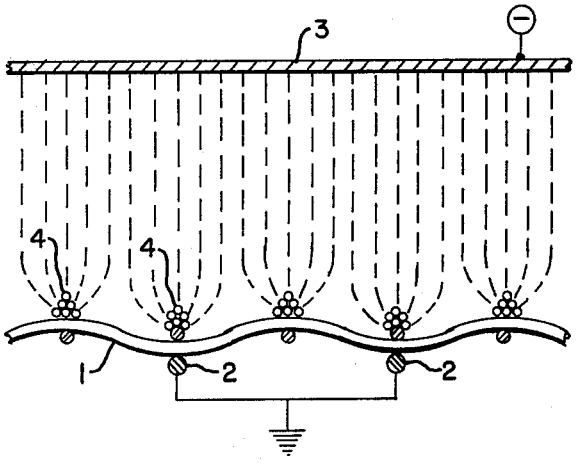

The principle of the present invention is illustrated diagrammatically in FIGS. 1A and 1B. Referring first to FIG. 1A, there is shown a section of a filter element 1 which may be a piece of tightly-woven cloth or other suitable textile fabric, and which is shown greatly magnified for clarity of illustration. The filter element 1 is supported on a grounded metal support 2 which may be a screen, grid or other suitable support. An electric field is provided at the surface of the filter element and is shown in the diagrammatic illustration as being produced by a conducting plate 3 disposed substantially parallel to the filter element 1 at a suitable distance. A high voltage, which may be negative, is applied to the plate 3 to provide an electric field generally perpendicular to the surface of the filter element 1, as indicated by the dotted lines which represent lines of force of the electric field. The field should be relatively high but with a voltage gradient such that no corona discharge can occur so that there is no substantial concentration of gas ions.

As shown in FIG. 1A, the electric field is substantially uniform between the plate 3 and the vicinity of the filter element 1, but in the immediate neighborhood of the filter, the field tends to concentrate in the location of the small irregularities or projections present on the surface of the filter element, as indicated by the convergence of the field lines. This phenomenon will occur at any slight projection or surface irregularity that may be present on the filter element 1 even if a very smooth surface is presented. The dust particles are electrically charged with the same polarity as the plates 3 and thus tend to follow the lines of force of the electric field. Each particle is driven by a force proportional to its charge multiplied by the strength of the electric field and the typical velocity of such particles in the direction of the field is of the order of 30 feet per minute relative to the air. The velocity of the air flowing through a typical dust filter would normally be from 1 to 10 feet per minute, so that the velocity of the charged dust particles relative to the air is higher than the velocity of the air itself and the dust particles are driven toward the filter element 1.

Individual dust particles 4 are indicated in FIG. 1A and tend to move along the lines of force in the directions indicated by the arrows. The particles, therefore, deposit on the projections or irregularities of the filter surface rather than being driven into the cloth itself. Since the dust is more conductive than the air, these deposited dust particles tend to further concentrate the field so that successive particles deposit on top of earlier ones. The dust particles, therefore, build up as shown in FIG. 1B in closely-spaced columns or pyramids at the irregularities or projections of the filter surface, the spacing being greatly exaggerated in the drawing for clarity. Thus, the layer of dust formed by deposit of the dust particles remains relatively porous even though a substantial thickness of dust may build up, and very effective filtering with low pressure drop is obtained. In the absence of an electric field, the dust would tend to follow the air flow into any pores or thinner areas that might exist, thus plugging them and forming a relatively impervious layer with high resistance to air flow. The presence of an electric field, however, causes the charged particles to deposit in the manner shown and results in a porous layer of dust. This keeps the pressure drop across the dust layer low, and also facilitates cleaning of the filter by reverse gas flow or similar means since the dust tends to fall off readily because it has deposited only on the surface irregularities.

Figure 2:
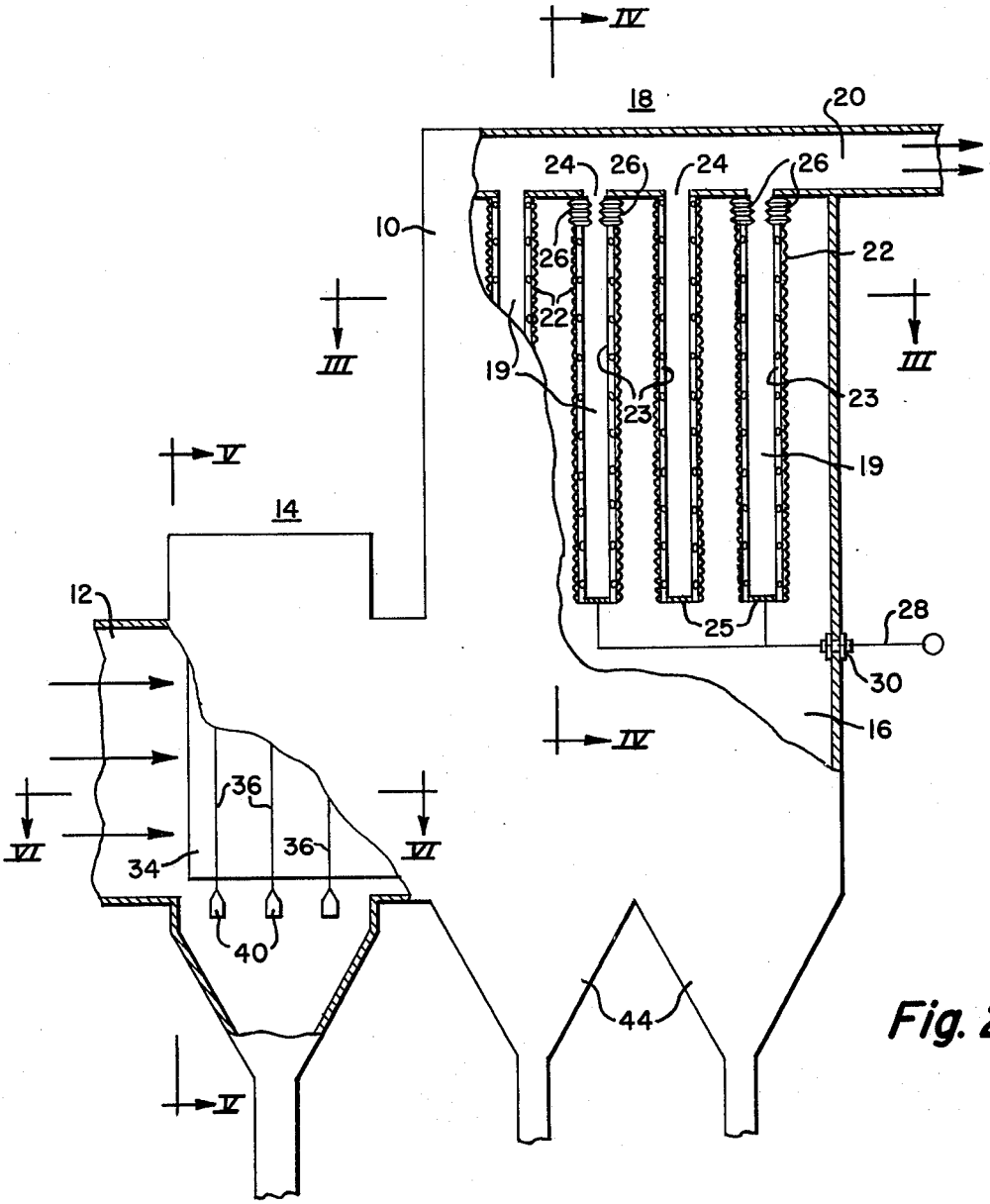
FIG. 2 is a view partly in elevation and partly in longitudinal section of a filter structure embodying the invention.

The copending application referred to above discloses a filter structure for removing charged particles from a stream of air or other gas by depositing them in an electric field as just described. The present invention provides a simpler and less expensive filter structure for collecting such particles. As shown in FIG. 2, the complete filter assembly may be contained in a sheet metal housing generally designated 10. The dust-laden air or other gas enters through a duct 12 at one side of the housing and is directed through a charging section 14 where the dust particles are electrically charged in a manner to produce a mixture of approximately equal numbers of particles with charges of opposite polarities. The dust-carrying gas is then directed by duct means generally indicated at 16 to a filtering section 18 where the dust is removed from the gas.

Figure 3:
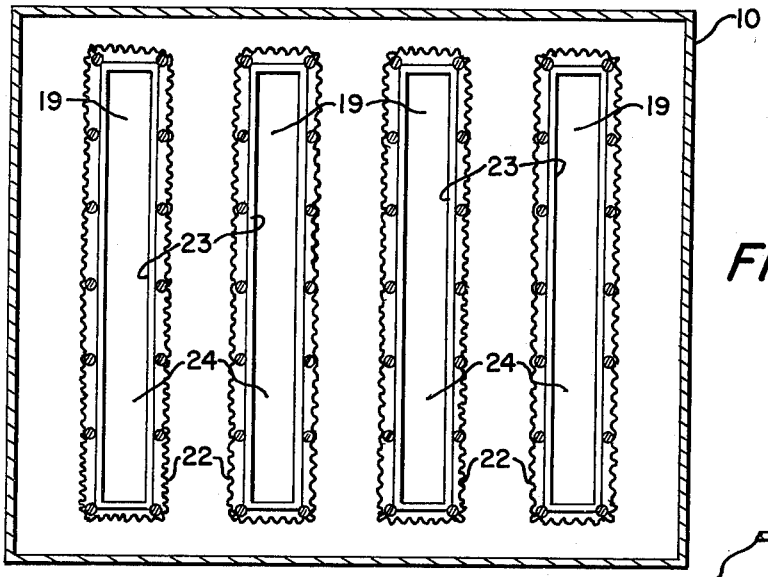
FIG. 3 is a horizontal sectional view substantially on the line III—III of FIG. 2.
Figure 4:
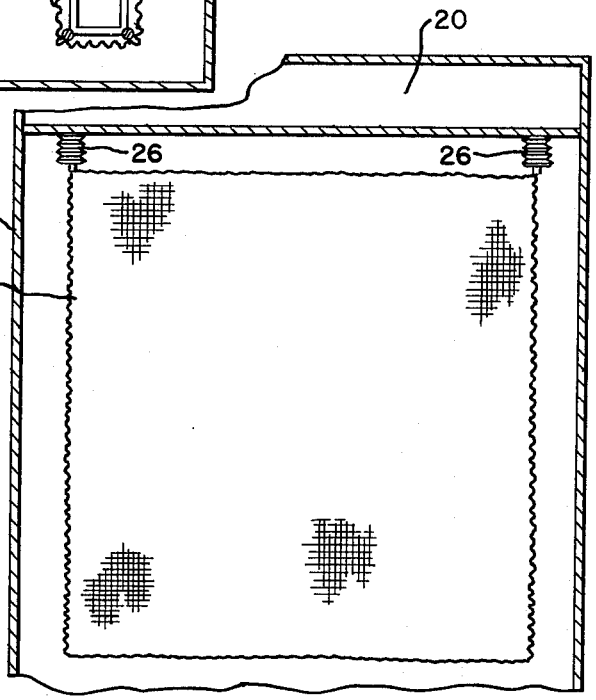
FIG. 4 is a transverse sectional view substantially on the line IV—IV of FIG. 2.

The filtering section 18 includes a plurality of filter members 19 which are shown as extending downward from the lower surface of a discharge duct 20 which extends across the top of the housing 10. Each of the filter members 19 consists of a filtering element 22 which may be made of tightly-woven cloth or other suitable textile fabric, or of any suitable porous filter material such as knitted or felted materials. The filter elements 22 are supported on conductive supports 23 which may be metal grids, as shown, or screens or other suitable metallic or conducting supports which are sufficiently open to not materially obstruct the flow of gas. As can be seen in FIG. 3, the supports 23 are preferably generally rectangular in cross section and the filter elements 22 are stretched over the supports to form the walls of vertical passageways 24. The dust-laden gas flows upward from the duct 16, through the filter elements 22 into the passageways 24, and up to the duct 20, the bottom of each of the passageways 24 being closed by an impervious sheet metal member 25.

In accordance with the present invention, alternate filter members 19 are maintained at ground potential. Thus, as seen in FIG. 2, the conductive supports 23 of alternate filter members are directly attached to the bottom of the duct 20, which forms a part of the sheet metal housing 10 and is thus effectively grounded. The intervening filter members 19, between the grounded filter members, are insulated from ground by means of insulators 26 on which the supports 23 of these filter members are suspended from the bottom of the duct 20. The insulated filter members are maintained at a suitable high potential applied through a conductor 28 which enters the housing 10 through an insulating bushing 30 and is connected as shown to the conducting supports 23 of the insulated filter members.

It will be seen that the filter elements 22 of adjacent filter members 19 provide spaced, parallel filter surfaces which form ducts between adjacent filter members, and that adjacent filter surfaces are maintained at opposite electrical polarities. That is, one of each pair of adjacent filter surfaces is at a high potential while the other surface is substantially at ground potential. A unidirectional, uniform electric field therefore exists across the duct formed by the adjacent parallel surfaces which is essentially perpendicular to the surfaces. If the high potential filter element is positive, for example, the adjacent grounded element is negative with respect to the high potential element, so that positively-charged dust particles in the duct between the elements will move toward the grounded element. The direction of the electric field is alternately in opposite directions in successive duct spaces between adjacent filter elements but the field is continuous and unidirectional in each space. If the last filter element 19 at the end of the assembly is at high potential, as at the right end in FIGS. 2 and 3, an electric field as described exists between the filter element and the grounded housing wall. Dust particles of one polarity will therefore deposit on the filter surface while those of opposite polarity may collect on the housing wall and ultimately fall to the bottom. If there is an even number of filter elements, as shown, the element at the left end is grounded. There will be no field between this element and the grounded housing wall and dust will deposit on the last filter surface in a relatively impervious layer. This will tend to clog this one filter surface and prevent substantial gas flow therethrough but the other filter surfaces will not be affected.

The voltage applied to the insulated filter members 19 should be high enough to provide the required electric field at the surfaces of the filter elements. The strength of the field or voltage gradient, however, should be such that no corona can occur so that there will be no substantial concentration of gas ions which could give rise to corona current. Such current would necessarily be conducted through the layer of dust and the fabric filter element. If the resistivity of the dust is low enough, this might be tolerated, but in most cases the resistivity can be sufficiently high to cause a voltage gradient in the dust exceeding the voltage gradient of the electric field itself. This effect would then cause the dust to deposit in any depressions in the dust layer, making more dense deposits and defeating the purpose of the invention. For this reason, no corona should be permitted to occur in the filtering section. It is, of course, difficult to define or to measure exactly what constitutes objectionable corona, or to state at what point corona might be said to occur. For the purposes of the present invention, however, a corona current not exceeding $10^{-11}$ amperes per square centimeter can be tolerated, and any corona current less than this value can be considered as being essentially zero.

As previously indicated, the filter structure of the present invention is intended to collect mixtures of dust particles charged at opposite polarities. The dust particles may, of course, be electrically charged in any desired manner. In the illustrative embodiment shown in the drawings the complete filter assembly includes a charging portion 14. The charging portion 14 is contained in the housing 10 and the entrance duct 12 conveys the dust-laden gas directly into the charging portion. As shown particularly in FIGS. 5 and 6, the charging portion 14 has a plurality of grounded metal plates 34 which may be supported in any suitable manner from the housing 10 and are grounded by their contact with the housing. The plates 34 extend generally parallel to the direction of gas flow and are suitably spaced apart so as to divide the charging section into a plurality of parallel ducts through which the dust-laden gas flows. In each of these ducts, a plurality of corona wires 36 are suspended from insulators 38. The wires 36 may have weights 40 at the lower ends to hold them under tension and a suitable number of wires 36 is provided in each of the ducts shown in FIG. 6.

Figure 5:
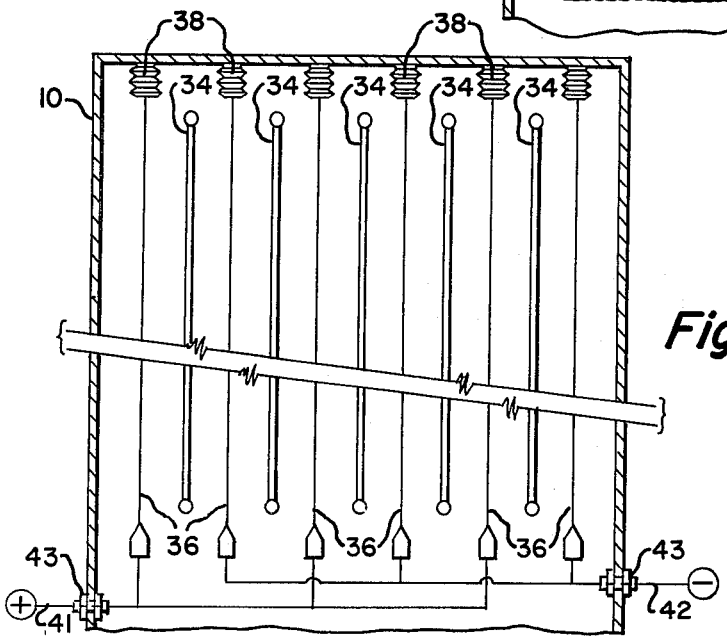
FIG. 5 is a transverse sectional view substantially on the line V—V of FIG. 2.
Figure 6:
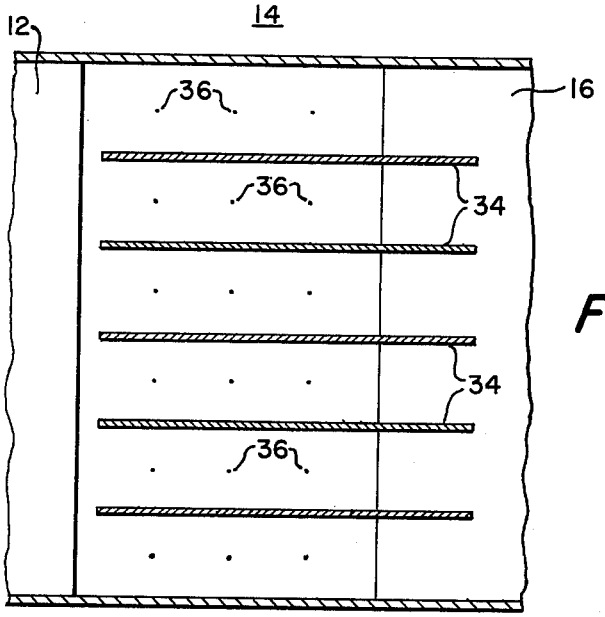
FIG. 6 is a horizontal sectional view substantially on the line VI—VI of FIG. 2.

The corona wires are maintained at a high enough voltage to produce corona discharges to the grounded plates and thus electrically charge dust particles passing between the wires and the plates. As indicated in FIG. 5, the wires 36 in alternate ducts between plates 34 are maintained at a high positive potential, and the wires 36 in the intervening ducts are maintained at a corresponding negative potential, positive and negative conductors 41 and 42 being brought through insulating bushings 43 and connected to the respective sets of wires 36 in any suitable manner. Since the gas flowing through the duct 12 into the charging section will divide between the parallel ducts formed by the plates 34, the dust particles carried by the gas will divide more or less evenly between the ducts, and after passing through the charging section, a mixture of dust particles results in which approximately half of the particles are positively charged and the other half negatively charged. Since the numbers of particles of each polarity are approximately equal, the net space charge resulting from the charged particles is essentially zero, or very close to zero, and no special provisions are needed to limit the magnitude of the space charge.

After passing through the charging section, the mixture of charged dust particles is directed by the duct 16 upward into the filter section 18. The duct 16 is part of the sheet metal housing 10 and its lower surface may be formed to provide a plurality of hoppers 44 for receiving dust removed from the gas. The dust-laden gas is directed by the duct 16 into the filtering section and flows into the duct spaces between the filter members and through the filtering elements 22 into the passages 24, and into the discharge duct 20. The charged dust particles are thus carried into the spaced between adjacent filter elements and into the unidirectional electric fields previously described. The dust particles tend to follow the lines of force of the electric field, the positively-charged particles being drawn toward the negative filter elements and the negatively-charged particles being drawn to the positive filter elements. As previously pointed out, the electrically-induced velocity of the particles relative to the gas is substantially higher than the component of gas velocity perpendicular to the filter surface. Thus, even though a negatively-charged particle, for example, may be close to the negative filter surface so that the gas is moving toward the surface, the net velocity of the particle is in the opposite direction toward the positive filter surface on which it will ultimately deposit. The dust is thus deposited on the filter surfaces in the electric field in the manner described above in connection with FIGS. 1A and 1B, so as to form relatively porous layers with low pressure drop across the dust layers. A very effective filtering action is thus obtained but the pressure drop remains relatively low and a desired flow of gas can be maintained through the filter without requiring excessive power. When cleaning is necessary or desired, the dust may be removed from the filters 19 by mechanically shaking or tapping them or by pulses of reverse gas flow. In either case, the duct readily falls from the filter as it has been deposited only on the surface projections or irregularities and falls freely into the hoppers 44 from which it may be removed.

Figure 7:
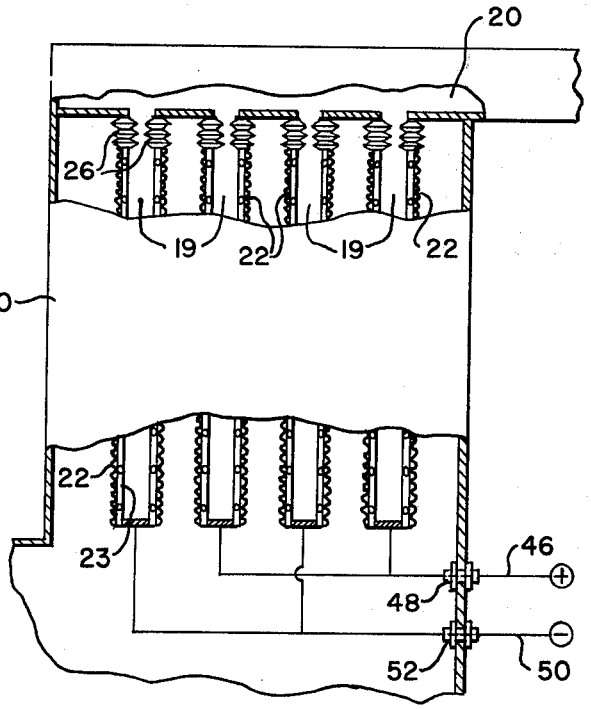
FIG. 7 is a fragmentary view of the filter section, partly in longitudinal section, showing a modified embodiment of the invention.

An alternative arrangement for producing the electric fields between adjacent filter elements is shown in FIG. 7. In this embodiment, all of the filter elements 19 are suspended from the duct 20 on insulators 26 so that they are all electrically insulated. Alternate filters 19 are maintained at a high positive potential from a conductor 46 which enters the housing 10 through an insulating bushing 48, and the intervening filters 19 are maintained at a high negative potential from a conductor 50 which enters the housing through an insulating bushing 52. Adjacent filter elements are thus maintained at opposite polarities and the electrical relations and the filtering operation are essentially the same as in the embodiment previously described. This arrangement, however, has an advantage in some cases since the maximum potential to ground is only one-half of that required in the previous embodiment to maintain the same voltage gradient between filter elements.

It will be understood that the dust particles may be charged in any desired manner, and in some cases the charging section 14 may not be needed. Thus, dusts resulting from mechanical abrasion are often electrically charged and consist of mixtures of positively-charged and negatively-charged particles. When dusts of this kind are to be collected, the dust-laden gas may be taken directly into the filtering section 18 without any further charging. It will also be understood that various modifications and changes may be made in the mechanical arrangement and that the configuration of the filter members may be other than rectangular, if desired.

It should now be apparent that a filter device has been provided for collecting dust or other particulate matter which provides effective filtering action and results in the formation of a relatively porous dust layer so that excessive pressure drops do not occur across the filter. This is done by depositing the dust on the filter element in an electric field, and a particular arrangement for this purpose has been provided which is relatively simple and which does not require the high potential plates which were previously necessary for producing the electric field, or the grounded plates, or other means, previously required for limiting the space charge due to the charged dust particles. Thus, a relatively simple and inexpensive filtering assembly has been provided.

I claim as my invention:

1. An electrostatic filter for collecting a mixture of electrically-charged solid particles of opposite polarities, said filter comprising spaced filter members having fabric filter elements with generally parallel surfaces, and said filter elements also have surface irregularities, means for maintaining a unidirectional electric field between said filter members in a direction generally perpendicular to said surfaces, whereby said filter members are of opposite relative polarities, and means for directing said mixture of particles into the space between the filter members in a direction generally parallel to said surfaces of the filter elements and transverse to said electric field to cause the particles to move in opposite directions in accordance with their polarities and to deposit on said surfaces in porous layers.

2. An electrostatic filter as defined in claim 1 including a plurality of spaced filter members, and means for maintaining unidirectional electric fields between adjacent filter members, and electric fields being alternately in opposite directions.

3. An electrostatic filter as defined in claim 1 including a plurality of filter members, each filter member having a conductive support means and a fabric filter element on the support means, said filter members being disposed so that the filter elements of adjacent filter members are in spaced, generally parallel relation, and means for maintaining said electric fields between adjacent filter members alternately in opposite directions.

4. An electrostatic filter as defined in claim 3 in which the support means of alternate filter members are grounded, and means for maintaining the support means of the remaining filter members at a high potential of one polarity.

5. An electrostatic filter as defined in claim 3 including means for maintaining the support means of alternate filter members at a high potential of one polarity and for maintaining the support means of the remaining filter members at a high potential of opposite polarity.

6. An electrostatic filter as defined in claim 1 and including means for electrically charging said particles with charges of opposite polarities, and duct means for directing said particles from said charging means to said filter members.

7. An electrostatic filter as defined in claim 6 in which said charging means includes a plurality of parallel plates extending in the direction of particle movement and forming ducts therefor, a plurality of corona wires disposed in said ducts, and means for maintaining the corona wires in adjacent ducts at opposite polarities.

8. An electrostatic filter comprising a plurality of filter members, each of said filter members comprising a conducting support and a fabric filter element, having surface irregularities, carried on the support and disposed to form the walls of a passageway, said filter members being mounted with said filter elements in spaced parallel relation to form ducts between them, means for directing a stream of particle-carrying gas to flow through said ducts into said passageways, said particles comprising a mixture of electrically-charged particles of opposite polarities, and means for maintaining a unidirectional electric field between adjacent filter members in a direction generally perpendicular to the surfaces of said filter elements and transverse to the direction of flow of said gas stream.

9. An electrostatic filter as defined in claim 8 in which the supports of alternate filter members are grounded, and means for maintaining a high potential on the supports of the remaining filter members.

10. An electrostatic filter as defined in claim 8 including means for maintaining the supports of alternate filter members at a high potential of one polarity, and means for maintaining the supports of the remaining filter members at a high potential of opposite polarity.

11. An electrostatic filter as defined in claim 8 and including means for electrically charging a portion of said particles with charges of one polarity and the remainder of said particles with charges of opposite polarity, and means for directing said stream of particle-carrying gas to flow first through said charging means and then to said filter means.

12. An electrostatic filter as defined in claim 11 in which said charging means includes a plurality of substantially parallel grounded plates extending in the direction of movement of said gas and forming passages for the gas between them, a plurality of corona wires disposed in spaced relation in each of said passages, and means for maintaining the corona wires in adjacent passages at high potentials of opposite polarities.

13. An electrostatic filter for collecting a mixture of electrically charged particles of opposite polarities, said filter including a plurality of filter members, each of said filter members having an electrically conducting support and a filter element disposed on the support and comprising a fabric capable of filtering and collecting said particles, and said filter element has surface irregularities, said filter members being disposed with adjacent filter elements in spaced, parallel relation, duct means for directing a stream of gas carrying said mixture of charged particles to flow in a direction generally parallel to the surfaces of said filter elements into the spaces between the filter elements and through the filter elements, and means for applying a voltage between the conducting supports of adjacent filter members such that adjacent filter members are of opposite polarities to maintain a substantially constant, unidirectional electric field between the surfaces of adjacent filter elements generally perpendicular thereto and transverse to the direction of flow of said gas stream to cause said charged particles to move in opposite directions in accordance with their polarities and to deposit on said surfaces in porous layers.

14. An electrostatic filter as defined in claim 13 in which alternate ones of said conducting supports are grounded, and means for applying a high potential of one polarity to the remaining supports.

15. An electrostatic filter as defined in claim 13 including means for applying a high potential of one polarity to alternate ones of said conducting supports, and means for applying a high potential of opposite polarity to the remaining supports.

* * * * *